US006503114B2

(12) United States Patent
Kawashima et al.

(10) Patent No.: US 6,503,114 B2
(45) Date of Patent: Jan. 7, 2003

(54) DIVING JACKET

(75) Inventors: Haruo Kawashima, Tokyo (JP); Minoru Takeuchi, Tokyo (JP); Kenji Kawana, Tokyo (JP)

(73) Assignee: Tabata Co., Ltd., Tokyo (JP)

( * ) Notice: Subject to any disclaimer, the term of this patent is extended or adjusted under 35 U.S.C. 154(b) by 0 days.

(21) Appl. No.: 10/044,953

(22) Filed: Jan. 15, 2002

(65) Prior Publication Data

US 2002/0094734 A1 Jul. 18, 2002

(30) Foreign Application Priority Data

Jan. 16, 2001 (JP) ..... 2001-008320

(51) Int. Cl.[7] ..... B63C 9/08
(52) U.S. Cl. ..... 441/116; 405/186
(58) Field of Search ..... 441/116; 405/186

(56) References Cited

U.S. PATENT DOCUMENTS 4,137,585 A * 2/1979 Wright, III ..... 114/332

* cited by examiner

*Primary Examiner*—Jesus D. Sotelo
(74) *Attorney, Agent, or Firm*—Clark & Brody

(57) ABSTRACT

A diving jacket includes a back-plate 22 and a pair of waist belt members respectively having circumferentially rear end regions fixed to the back-plate 22 by a means of associated connector plates 31. Rear end regions 37 of the respective connector plates 31 are formed with a plurality of dovetail tenons 51 or a plurality of dovetail grooves 52 arranged in vertical direction of the connector plates 31 so as to extend in parallel one to another and the back-plate 22 is formed with much more dovetail grooves 52 or dovetail tenons 51 than those formed in the connector plates 31 so as to be operatively associated with the dovetail tenons 51 or dovetail grooves 52 of the connector plates 31, respectively.

1 Claim, 6 Drawing Sheets

DIVING JACKET

BACKGROUND OF THE INVENTION

This invention relates to a diving jacket having a buoyancy regulating function.

Japanese Patent application Publication No. 1993-112291A discloses a diving jacket including a buoyancy regulator for diving which comprises a buoyancy regulating bag provided with a pair of shoulder belts and a waist belt. The shoulder belts extend downward from respective shoulder regions of the buoyancy regulating bag and fixed to the waist belt. The waist belt comprises a pair of belt members extending from both sides of a wearer's waist region in a circumferential direction and fixed to a back-plate lying on the back of the buoyancy regulating bag by a means of plural bolts.

In the case of the above-cited well known buoyancy regulator, the positions at which the belt members are secured by bolts may be appropriately selected to adjust a vertical position of these belt members relative to the back-plate. However, this position adjustment requires troublesome operation of clamping or slackening a plurality of bolts.

SUMMARY OF THE INVENTION

It is an object of this invention to improve the diving jacket so as to facilitate the position-adjustment of the waist belt in vertical direction of the jacket.

According to this invention, there is provided a diving jacket comprising a jacket adapted to be inflated with air for buoyancy regulation, a back-plate mounted on an inner surface of the jacket's back so as to extend in vertical direction of the jacket so that a cylinder for supply of the air is fixed thereto, a pair of length-adjustable shoulder belts extending downward from respective shoulder regions of the jacket and a length-adjustable waist belt extending in a circumferential direction of the jacket.

The waist belt comprises a pair of belt members extending from both sides of the wearers waist of the diving jacket in the circumferential direction. These belt members respectively having circumferentially front end regions detachably connected to each other and rear end regions opposed to respective the front end regions wherein the rear end regions are fixed to circumferentially front sections of associated connector plates disposed between respective the rear end regions and the back-plate.

The connector plates are respectively formed in the circumferentially rear sections with a plurality of dovetail tenons or a plurality of dovetail grooves arranged in vertical direction of the connector plates so as to extend in parallel one to another so that the circumferentially rear sections can be detachably engaged with transversely opposite sides of the back-plate by slidably moving toward the back-plate in the circumferential direction and the back-plate is formed along the transversely opposite sides with much more dovetail grooves or dovetail tenons than those formed in the connector plates so as to be operatively associated with those of the connector plates; and the connector plates and back-plate are formed with a stopper means by which disengagement between the dovetail tenons and dovetail grooves are temporarily prevented.

DETAILED DESCRIPTION OF THE PREFERRED EMBODIMENTS

Details of a diving jacket according to this invention will be more fully understood from the description given hereunder with reference to the accompanying drawings.

Figure 1:
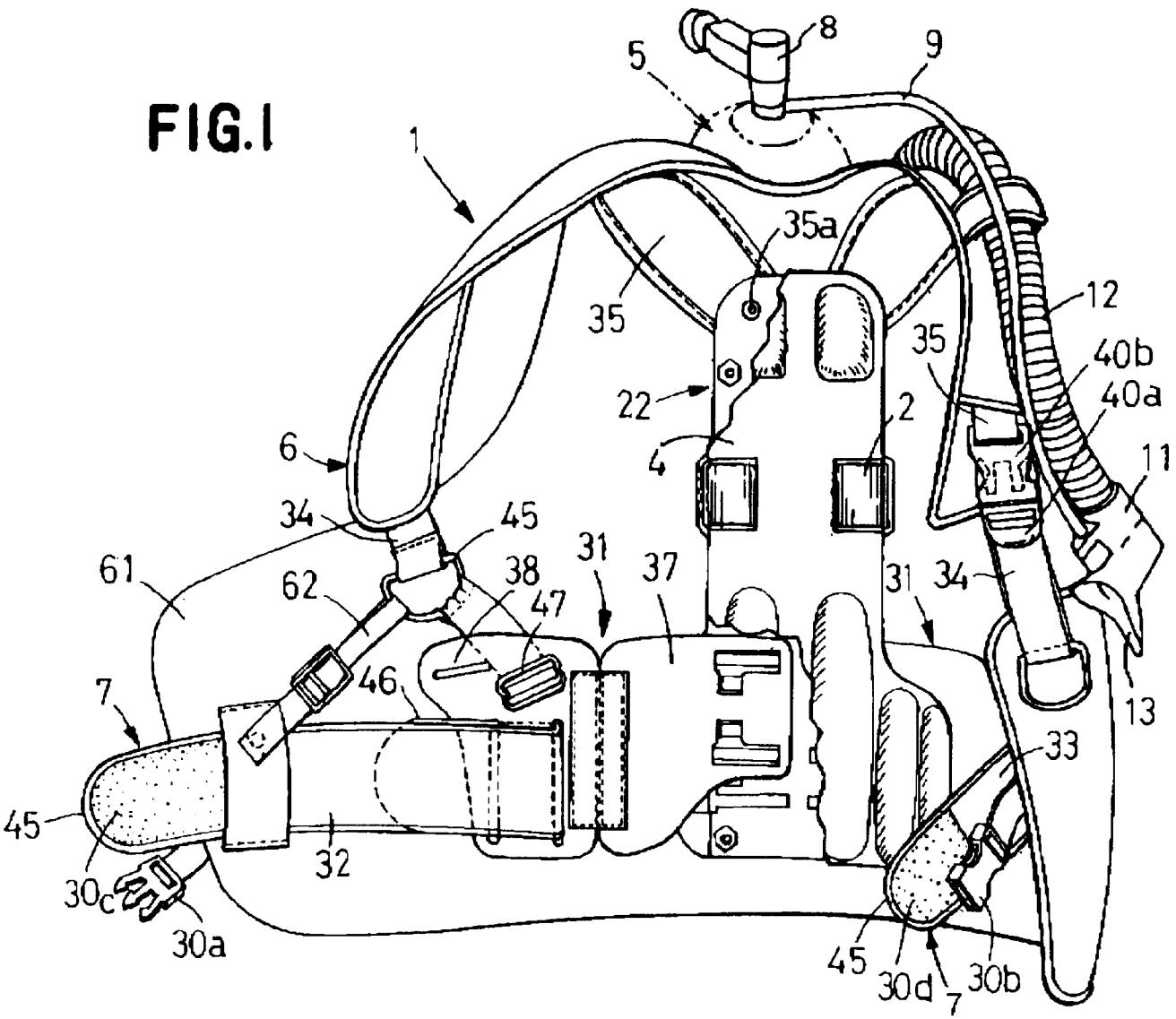
FIG. 1 is a partially cutaway front view showing a diving jacket.
Figure 2:
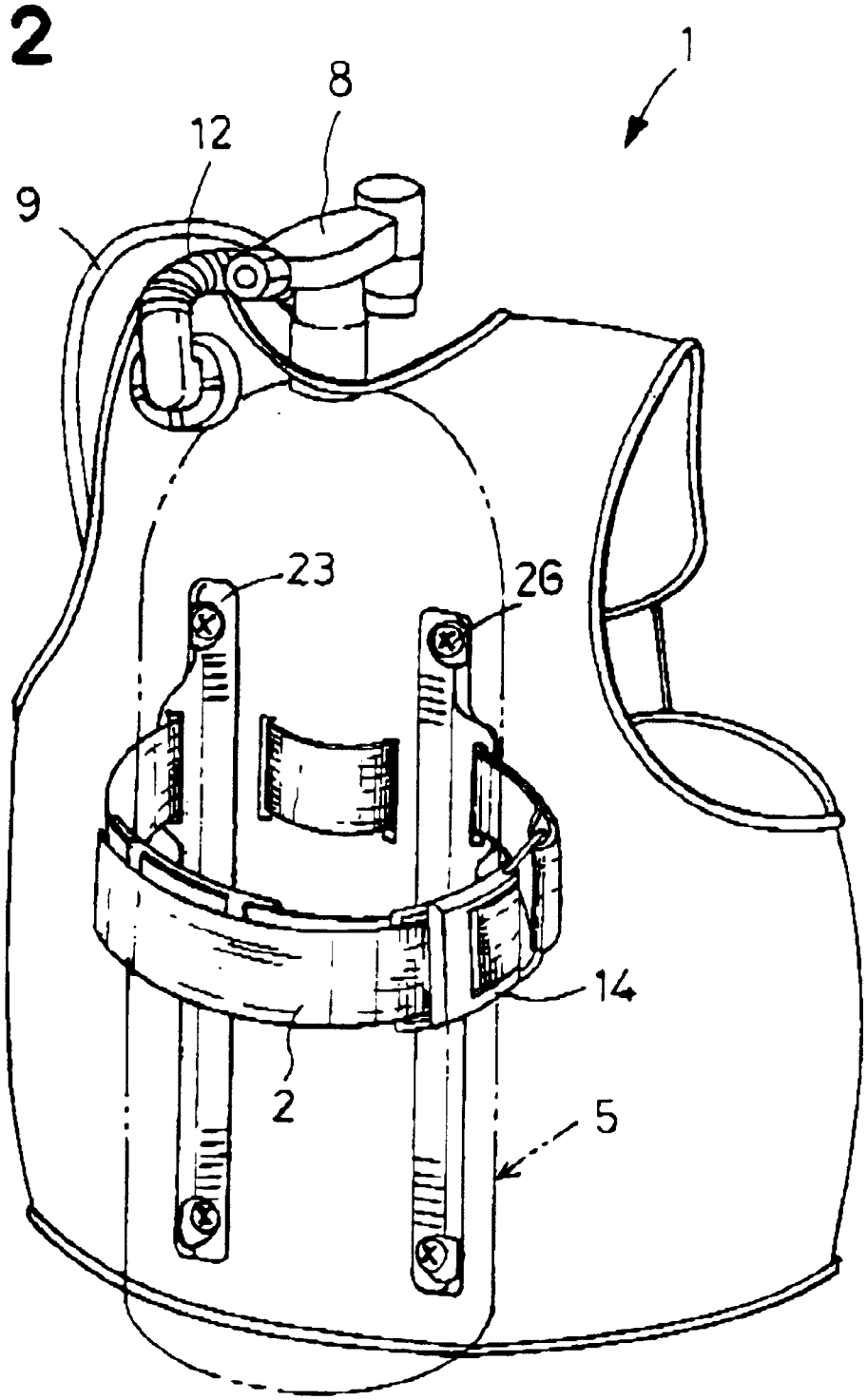
FIG. 2 is perspective view showing the diving jacket as viewed from it's backside.

FIG. 1 is a partially cutaway front view showing a diving jacket 1, and FIG. 2 is a perspective view showing the diving jacket 1 as viewed from its backside wherein an air cylinder 5 fastened to the jacket 1 is indicated by an imaginary line.

The jacket 1 is of the type adapted to be inflated with buoyancy regulating air and has shoulder belts 6 and a waist belt 7 both adapted to be length-adjustable, and a cylinder band 2 provided on the backside to fasten the air cylinder 5. The cylinder band 2 extends through the rear body region of the jacket 1 so as to disappear once from its outer side into its inner side and to appear again on the outer side from the inner side. Longitudinally opposite ends of the cylinder band 2 are length-adjustably connected to each other by a means of a buckle 14. The jacket 1 is provided on the inner side of the rear body region with a back-plate 22 extending in vertical direction and on outer side of the rear body region with a pair of plate members 23 extending in vertical direction. These plate members 23 are secured by a means of bolts 26 to the back-plate 22 along its transversely opposite side edge regions with the jacket 1 sandwiched between these plate members 23 and the back-plate 22. The air cylinder 5 is positioned between the pair of plate members 23 and fastened by the cylinder band 2 with respect to the back-plate 22 The air cylinder 5 is provided at its top with a first stage 8 from which a regulator hose 9 extends to a second stage 11 From the second stage 11, an inflation hose 12 extends to the rear body region of the jacket 1 so that the jacket 1 can be inflated with air. A mouthpiece 13 is attached to the second stage 11.

The back-plate 22 is made of a rigid plastic material or the like and retained in contact with the wearer's back with a cushion pad 4 placed upon the inner surface of the back-plate 22 substantially without an anxiety of undesirable deformation during use of the jacket 1. The pack-plate 22 is provided on each side of its lower end region with a pair of connector plates 31 extending in circumferential direction of the jacket 1.

The waist belt 7 comprises a flexible and easily deformable first belt member 32 extending in the circumferential direction from the right side of the jacket wearer's torso and a flexible and easily deformable second belt member 33 extending in the circumferential direction from the left side of the jacket wearer's torso. These belt members 32, 33 are provided on circumferentially forward end regions 45 with male and female fasteners 30*a*, 30*b* adapted to be detachably engaged with each other and a pair of planar fasteners 30*c*, 30*d* well known in the trademark of VELCRO adapted to be separably engaged with each other well known in the trademark of VELCRO, respectively. The circumferentially rear end regions 46 are connected by means of the respective connector plates 31 to the back-plate 22.

Each of the shoulder belts 6 has its upper end 35 fixed by a bolt 35*a* to an upper end region of the back-plate 22 and a lower end region extending downward from the shoulder region of the jacket 1 and fixed to an upper region of the associated connector plate 31. The upper end region 35 and the lower end region 34 are detachably connected to each other by a means of male and female fasteners 40*a*, 40*b* adapted to adjust a length of the belt 6. The lower end region 34 is divided by a means of a D-ring 45 provided in an intermediate region of the lower end region 34 into an upper branch and a lower branch from this D-ring 45, a length-adjustable supporting belt 62 extends to support a front body region 61 of the jacket 1 from the inner side of the front body region 61.

Figure 3:
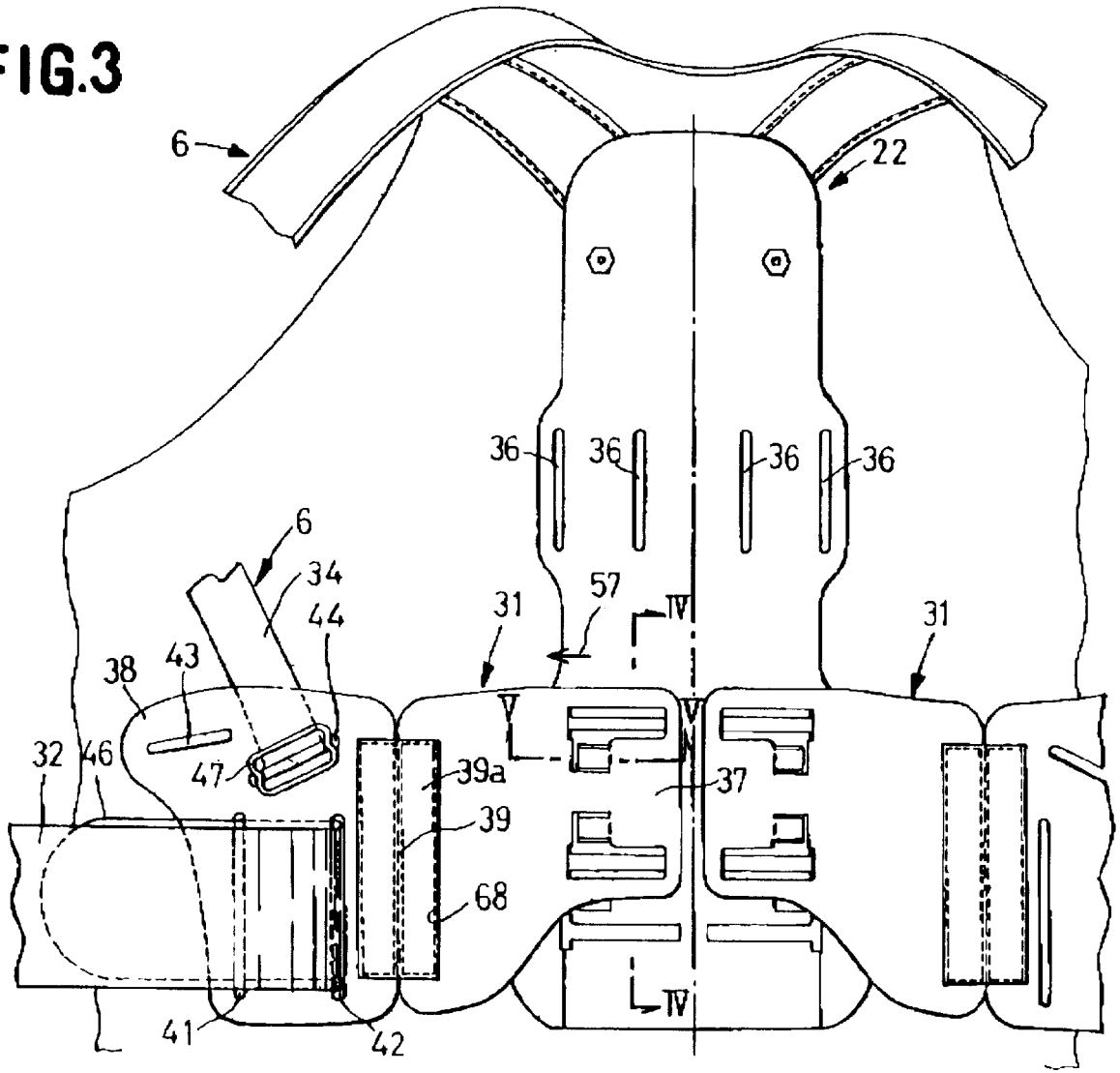
FIG. 3 is front view showing important parts of the diving jacket.

FIG. 3 is a front view showing important parts of the diving jacket 1 arranged on its inner side. It should be understood that cylinder 5 and the cushion pad 4 have been eliminated for clarity of illustration. The back-plate 22 is formed in its upper region with a plurality of vertically long through-holes 36 adapted for insertion of the cylinder band 2 and provided in its lower region on both sides with the connector plates 31, respectively. Each of the connector plates 31 has its circumferentially rear section 37 fixed to the back-plate 22 and its circumferentially front section 38 formed with, in addition to first and second insertion slits 41, 42 vertically extending in parallel to each other and serving to fix the first belt member 32 or the second belt member 33, third and fourth insertion slits 43, 44 extending in angles different from each other serving to fix the lower end regions of the respective shoulder belts 6. The rear section 37 and the front section 38 are connected to each other in a circumferentially intermediate region 39 by a means of a flexible sheet 39*a* such as a woven fabric or a plastic sheet which is stretchable neither in the circumferential direction nor in the direction orthogonal to this circumferential direction. While the connector plate 31 itself is a plate-like member formed of a deformation-resistant rigid material such as an ABS resin, a polypropylene resin, a nylon resin or a rigid synthetic rubber, the intermediate region 39 allows the front section 38 and the rear section 37 to bend inward or outward along the jacket wearer's torso depending on the size of his or her torso. In the case of the intermediate region 39 formed of a woven fabric, this woven fabric may be fixed to the front and rear sections 38, 37 of the connector plate 31 by stitching the woven fabric to them with a thread 68. It is also possible to fix the flexible sheet 39*a* to the front and rear sections 38, 37 using a welding technique or a mechanical means. The first and second belt members 32, 33 may be length-adjustably fixed to the respective connector plates 31 by guiding respective rear ends 46 of these belt members 32, 33 through the second insertion slits 42 of the respective connector plates 31 from the inner sides of these connector plates 31, then folded forward in the circumferentially of the wearer's torso on the outer side of the connector plates 31 and finally guiding the respective rear ends 46 through the first insertion slits 41. Each of the shoulder belts 6 is provided at its lower end 34 with an oval stopper member 47 of which the major diameter is larger than a width of the belt 6 and which may be inserted in the direction of the major diameter through third or fourth insertion slits 43 or 44 of the associated connector plate 31 to fix the shoulder belt 6 to the connector plate 31. The third insertion slit 43 or the fourth insertion slit 44 may be selected depending on a particular body size of the jacket wearer.

Figure 4:
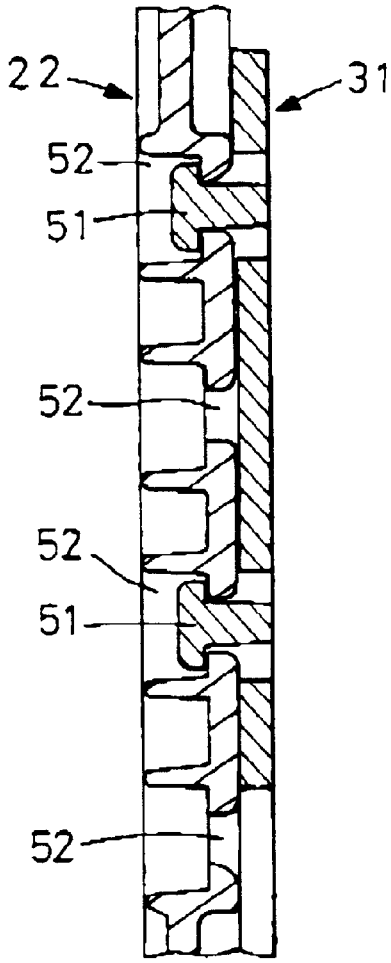
FIG. 4 is sectional view taken along a line IV—IV in FIG. 3.

FIG. 4 is a sectional view taken along a line IV—IV in FIG. 3. The connector plate 31 is provided with two dovetail tenons 51 arranged in vertical direction so as to extend in parallel to each other while the back-plate 22 is provided with four dovetail grooves 52 which are also arranged in vertical direction so as to extend in parallel one to another. The dovetail tenons 51 may be slid rearward in the circumferential direction to be detachably engaged with the corresponding dovetail grooves 52.

Figure 5:
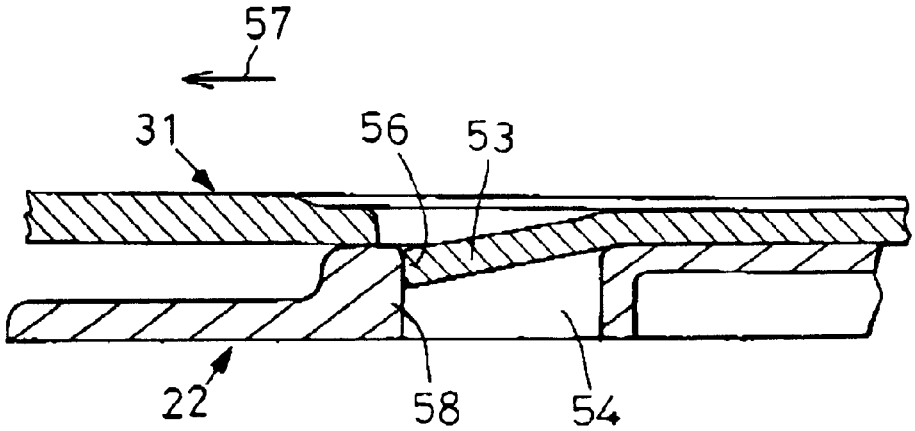
FIG. 5 is sectional view taken along a line V—V in FIG. 3.

FIG. 5 is a sectional view taken along a line V—V in FIG. 3. The connector plate 31 includes a stopper plate region 53 which is elastically deformable in vertical direction as viewed in FIG. 5 while the back-plate 22 includes a recess 54. The stopper plate region 53 has its free end portion 56 adapted to be received in the recess 54 so that the free end portion 56 will be tightly pressed against a side wall of the recess 54 if the connector plate 31 tends to move forward in the circumferential direction as indicated by an arrow 57 (See FIG. 3 also) away from the back-plate 22. The connector plate 31 is retained thereby in engagement with the back-plate 22. If it is desired to disengage the connector plate 31 from the back-plate 22, the stopper plate region 53 may be elastically deformed using a suitable tool such as a driver so that the stopper plate region 53 can climb over the side wall 58 of the recess 54.

Figure 6:
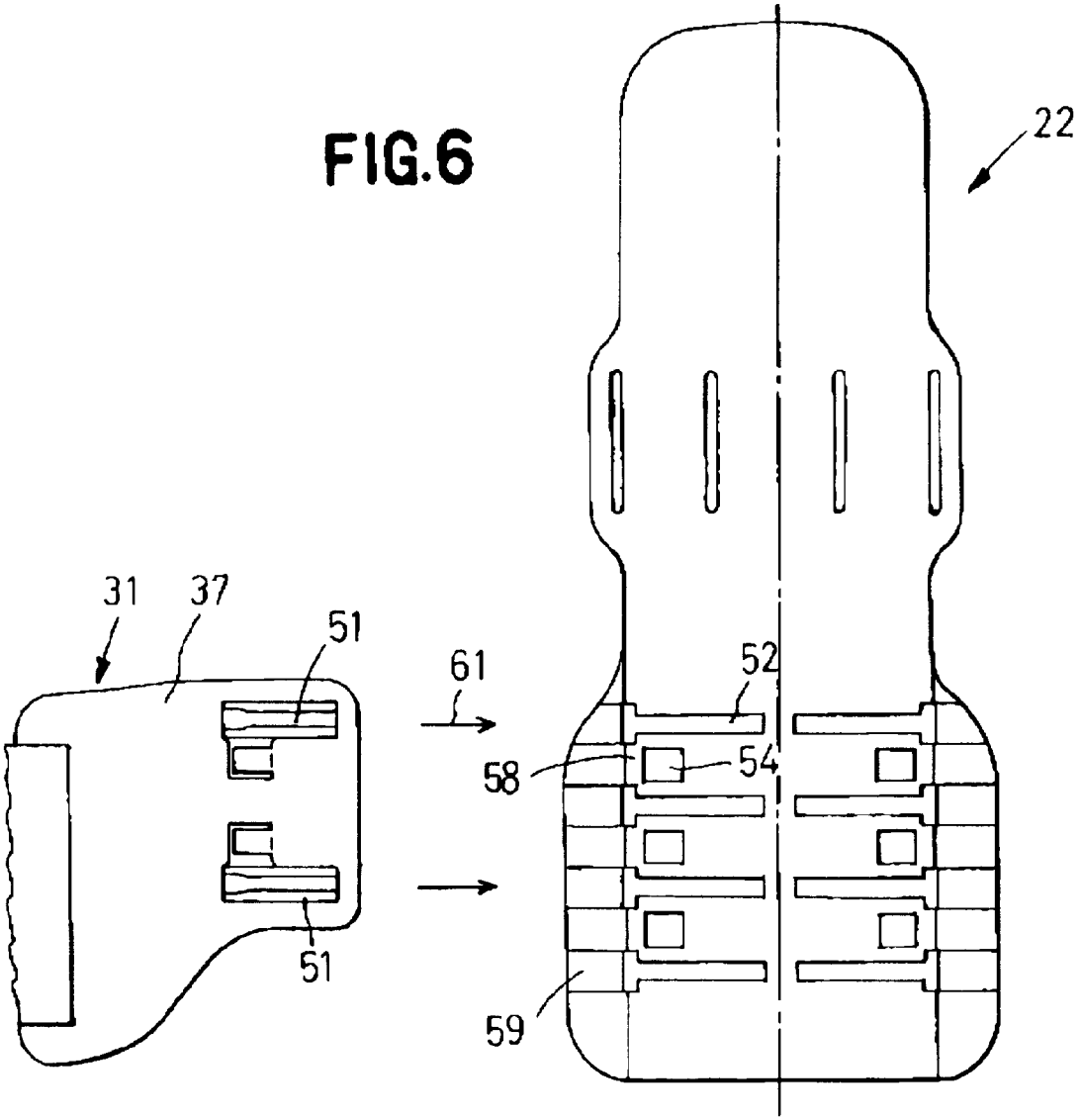
FIG. 6 is plan view showing the back plate and the connector plate.

FIG. 6 is a plan view showing the back-plate 22 and the connector plate 31 disengaged from the back-plate 22. The dovetail grooves 52 formed on the back-plate 22 are arranged at regular intervals in vertical direction and the recess 54 is formed between each pair of the adjacent dovetail grooves 52, 52. In the vicinity of transversely opposite side edges of the back-plate 22, relatively wide guide grooves 59 are formed so as to be contiguous to the respective dovetail grooves 52. The pair of dovetail tenons 51 formed in the rear section 37 of the connector plate 31 are adapted to be inserted into the corresponding two dovetail grooves 52 of the jacket 1 from the front to the back in the circumferential direction as indicated by an arrow 61. In the case of the illustrated connector plate 31, the pair of dovetail tenons 51 spaced from each other in vertical direction are arranged so that these two dovetail tenons 51 may be inserted into alternately selected two dovetail grooves 52. In the course of inserting the dovetail tenon 51 into the dovetail groove 52, the stopper plate region 56 of the connector plate 31 is brought in contact with the side wall 58 of the recess 54 from the front in the circumferential direction, then elastically deformed and received in the recess 54. Selection of the dovetail grooves 52 enables the vertical positions of the connector plate 31 and the belt member 32 fixed thereto to be adjusted with respect to the jacket 1.

With the jacket 1 constructed in the manner as has been described, the lower end regions 34 of the respective shoulder belts 6 are fixed to the associated connector plates 31 which are made of rigid material and easily deformable in- and outward in the circumferential direction in the hinge-like regions 39 defined by flexible sheets. Thus, the upper and lower end regions 34, 35 are supported by the back-plate 22 and the connector plates 31 both being sufficiently deformation-resistant. The shoulder belts 6 may be length-adjustably tightened after such jacket 1 has been worn to prevent the waist belt 7 from shifting in vertical direction. This is because the tension exerted on the belts 6 is absorbed by the pack-plate 22 and the connector plates 31 which are sufficiently resistant to deformation in the direction of such tension before the tension might be transmitted to the waist belt 7. In other words, once the air cylinder has been properly position by tightening the waist belt 7, it is not likely that the air cylinder 5 might be unintentionally shifted in vertical direction even if the shoulder belts 6 are later length-adjusted. In this way, the diver has his or her center of gravity well stabilized.

The connector plates 31 can be engaged with or disengaged from the back-plate 22 merely by sliding the connector plates 31 with respect to the back-plate 22 in the circumferential direction. This feature facilitates the waist belt 7 to be position-adjusted in vertical direction of the jacket 1. Such jacket 1 is particularly advantageous as a rental jacket destined to be used by many and unspecified divers.

Figure 7:
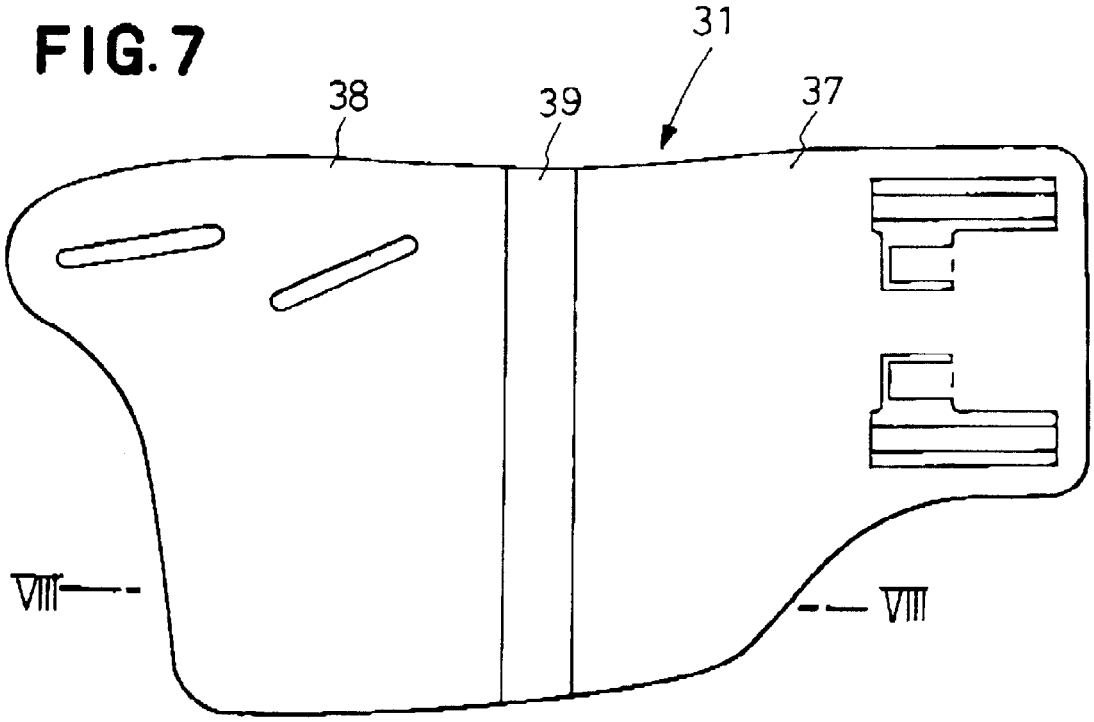
FIG. 7 is plan view showing another embodiment of the connector plate.
Figure 8:
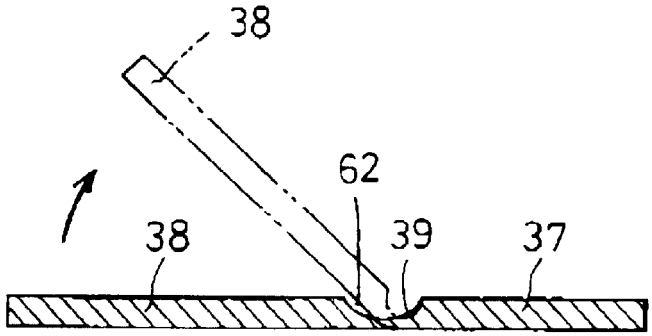
FIG. 8 is sectional-view taken along a line VIII—VIII in FIG. 7.

FIG. 7 is a plan view showing another embodiment of the connector plate 31 used in this invention and FIG. 8 is a sectional view taken along a line VIII—VIII in FIG. 7. This connector plate 31 also is formed of a rigid material such as an ABS resin, a polypropylene resin, a nylon resin or a rigid synthetic rubber and comprises the planar rear section 37 and the planar front section 38. The circumferentially intermediate region 39 extending between these two sections 37, 38 is formed with single or plural U-shaped groove(s) while the connector plate 31 is neither stretchable nor deformable in the circumferential direction as well as the vertical direction, a bottom of each groove 62 is thinner than the sections 37, 38 and functions like the intermediate region 39 shown in FIG. 3. Therefore, the bottom of the groove 62 enables the front section 36 to be easily bent, for example, inward in the circumferential direction as indicated by an imaginary line.

Without departing from the scope of this invention, it is possible to for the back-plate 22 with the dovetail tenons 51 and to form the connector plate 31 with the dovetail grooves 52. In this case, the number of the dovetail tenons 51 will exceed the number of the dovetail grooves 52.

In the diving jacket according to this invention, the connector plates respectively connected to the rear end regions of the respective belt members are adapted to be slid in detachable engagement with the back-plate of the jacket and positions in vertical direction of the back-plate at which the belt members are detachably engaged with the back-plate are selectable so that the belt members can be easily position-adjusted depending on a particular wearer of the jacket.

What is claimed is:

1. A diving jacket comprising:

a jacket adapted to be inflated with air for buoyancy regulation;

a back-plate mounted on an inner surface of said jacket's back so as to extend in vertical direction of said jacket so that a cylinder for supply of said air is fixed thereto;

a pair of shoulder belts extending downward from respective shoulder regions of said jacket;

a waist belt extending in a circumferential direction of said jacket;

said waist belt comprising a pair of belt members extending from both sides of waist of the wearer of said diving jacket in the circumferential direction, said belt members respectively having circumferentially front end regions detachably connected to each other and rear end regions opposed to respective said front end regions wherein said rear end regions are fixed to circumferentially front sections of associated connector plates disposed between respective said rear end regions and said back-plate;

said connector plates being respectively formed in said circumferentially rear sections with a plurality of dovetail tenons or a plurality of dovetail grooves arranged in vertical direction of said connector plates so as to extend in parallel one to another so that said circumferentially rear sections are detachably engaged with transversely opposite sides of said back-plate by slidably moving toward said back-plate in said circumferential direction and said back-plate is formed along said transversely opposite sides with much more dovetail grooves or dovetail tenons than those formed in said connector plates so as to be operatively associated with those of said connector plates; and said connector plates and back-plate being formed with stopper means by which disengagement between said dovetail tenons and dovetail grooves are temporarily prevented.

* * * * *